United States Patent [19]

Foster

[11] 4,057,027

[45] Nov. 8, 1977

[54] BOAT PROPULSION WITH SURFACE-RUNNING PROPELLER DRIVE

[76] Inventor: Daniel S. Foster, 19661 Kings Court West, Grosse Pointe Woods, Mich. 48236

[21] Appl. No.: 635,167

[22] Filed: Nov. 25, 1975

Related U.S. Application Data

[63] Continuation-in-part of Ser. No. 495,661, Aug. 8, 1974, abandoned.

[51] Int. Cl.[2] ..... B63H 5/16

[52] U.S. Cl. ..... 115/39; 114/271; 115/37

[58] Field of Search ..... 115/37, 39, 42; 114/162, 163; 9/6 P

[56] References Cited

U.S. PATENT DOCUMENTS

| | | | |
|---|---|---|---|
| 835,530 | 11/1906 | Huff | 115/39 |
| 1,681,342 | 8/1928 | Hickman | 114/288 |
| 2,896,565 | 7/1959 | Stevens | 115/42 |
| 3,147,730 | 9/1964 | Specht | 114/163 |
| 3,315,284 | 4/1967 | Ludlow | 9/6 P |
| 3,515,087 | 6/1970 | Stuart | 115/39 |
| 3,626,894 | 12/1971 | Stuart | 115/39 |
| 3,793,980 | 2/1974 | Sherman | 115/39 |

*Primary Examiner*—Trygve M. Blix
*Assistant Examiner*—Stuart M. Goldstein
*Attorney, Agent, or Firm*—Whittemore, Hulbert & Belknap

[57] ABSTRACT

A vee bottom boat having one or two inboard engines with the drive shafts thereof extending through the hull to position a propeller in a position such that when the boat is planing at cruising speed the propeller will be surface-running or operating in half-submerged condition. A rudder is located directly in rear of the propeller. A partly cylindrical splash guard is provided over the propeller and prevents "rooster-tailing." In addition, a water supply duct having a radius approximating that of the propeller is provided extending forwardly a short distance from the propeller. A transmission connecting the engine to a propeller shaft includes a chain which permits advantageous location of the propeller shaft relative to the engine and its output shaft.

12 Claims, 6 Drawing Figures

FIG. 1
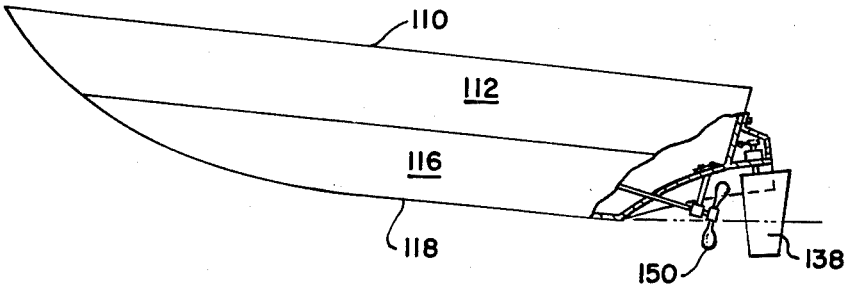
FIG. 3
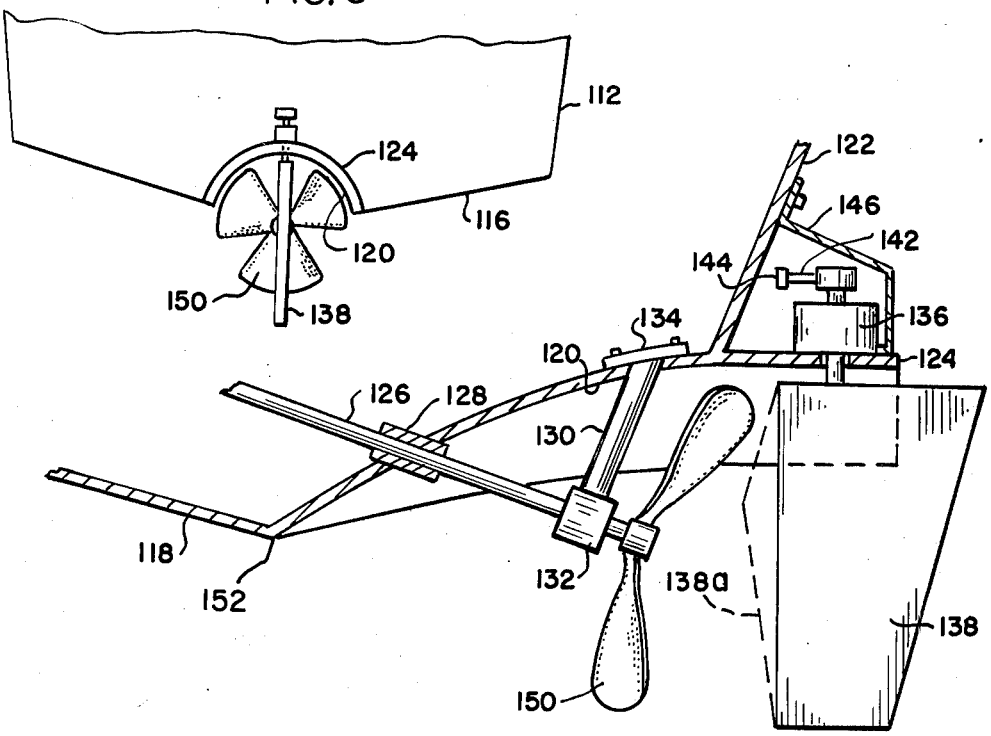
FIG. 2

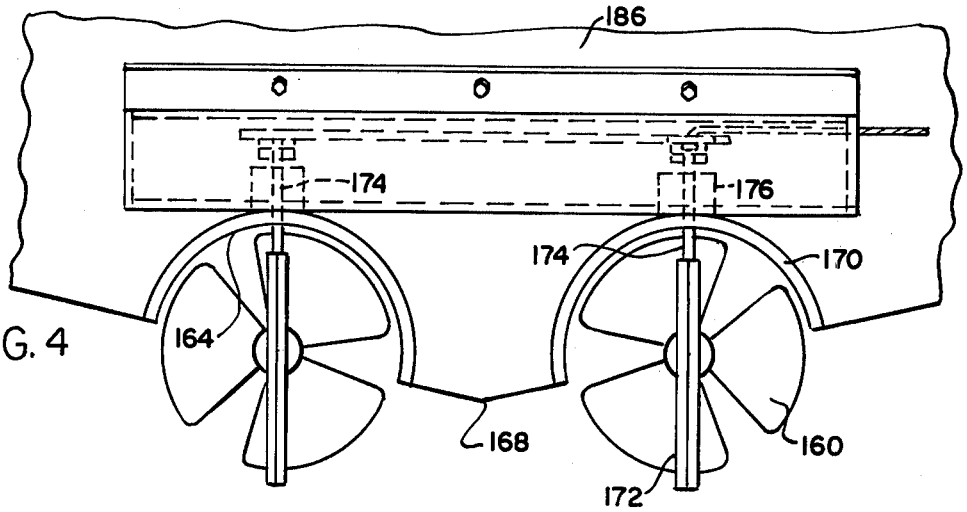
FIG. 4
FIG. 5
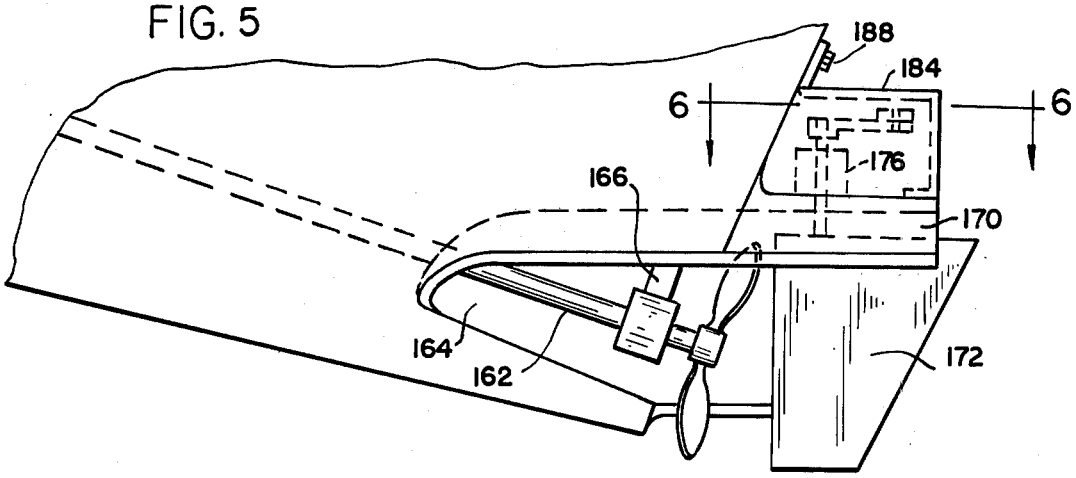
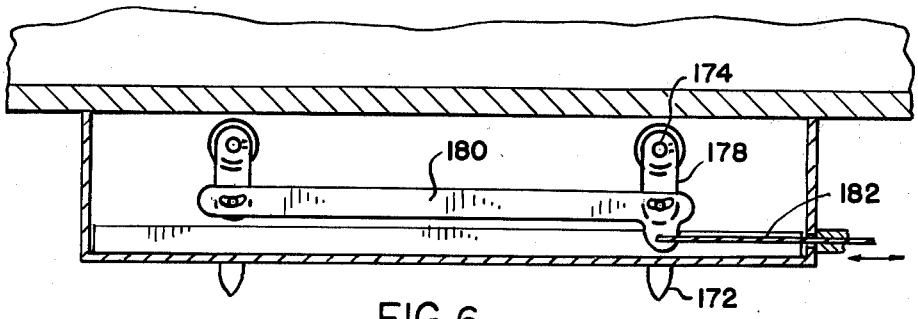
FIG. 6

BOAT PROPULSION WITH SURFACE-RUNNING PROPELLER DRIVE

CROSS REFERENCE TO RELATED APPLICATION

The present application is a continuation-in-part of prior copending application, Ser. No. 495,661, filed Aug. 8, 1974 now abandoned.

BRIEF SUMMARY OF THE INVENTION

The present invention relates to a boat of the type referred to as a wide vee bottom boat in which the hull has flat bottom surfaces inclined upwardly and outwardly from a center line at an angle usually between 15° and 30°, and preferably between 17° and 27°. The hull is provided with a flat transom at its stern which conveniently may incline upwardly and rearwardly at an angle of about 12°.

The flat bottom surfaces of the hull extend to substantially vertical sides which converge forwardly to the bow.

The dimensions of the hull may be such as to accommodate a single engine, in which case the single propeller will of course be located amidships. Alternatively, the dimensions may be such that two engines may be provided, each of which drives a single propeller, the propellers of course being located symmetrically with respect to the center line.

A very important feature of the boat design is that the propeller is positioned close to the transom and located such that its center line is brought substantially to the surface of the water directly astern of the boat when the boat is at planing speed, as a result of forward motion of the boat.

When the boat is at rest in the water it will be submerged to a predetermined depth such that the propeller is substantially submerged. For a single engine boat the rest inclination of the boat will be approximately forwardly and upwardly at about 5°. If the boat is provided with two engines the rest inclination may be forwardly and upwardly at about 13°. In both cases however, when the boat is being operated within the cruising range above 30 miles per hour, the boat will assume a planing inclination of about 13° and at these speeds it will be elevated so that only the after-portion of the boat is submerged.

Partly for the purpose of preventing cavitation before the boat reaches a cruising speed, water supply duct means are provided located just forwardly of the propeller, or of both propellers where a twin screw drive is used. These duct means, so far as permitted by space considerations, extend forwardly from a projection of the propeller or propellers for a distance of 6" to a foot or more depending on the size of the propeller, and intersect the flat surfaces of the vee bottom at sharp or faired corners. The ducts are of generally circular cross-section, and as a rule of thumb, the radius may approximate the radius of the associated propeller, or be slightly larger, to provide clearance for the propeller. With this arrangement, as the speed of the boat increases, the water tends to break away as it flows past the sharp corner at the edge of the duct rather than flowing around the corner filling the duct. However, at slow speeds, the water fills or substantially fills the ducts and flows to the propeller, thus providing adequate thrust and preventing cavitation.

It will be understood that for a single engine boat the propeller shaft will occupy this duct, where a single duct is provided, and where the duct cross-section constitutes a forward projection of the single propeller. In some cases, for a single engine, a pair of ducts is provided, each of which occupies as much of the forward projection of the propeller as is permitted. The propeller shaft passes through a stuffing box or water seal provided on the transom or the portion of the hull through which the shaft extends.

The location of the propeller is of first importance and where a single engine and gear box has its output shaft coupled directly to the propeller shaft, the downward and rearward inclination of the propeller shaft may be greater than is theoretically desirable. In practice, the propeller shaft is inclined downwardly and rearwardly at an angle of about 17°. However, where a chain drive is provided in which the propeller shaft is connected to the engine gear box transmission as disclosed herein, the downward and rearward inclination of the propeller shaft may be as small as 5° or 6°.

Carried at the rear of the transom by a suitable bracket is a rudder which is located directly in rear of the propeller. With this arrangement a rearward displacement of water by the propeller will provide maximum efficiency in steering. Where two propellers are used it will be normal to provide two rudders, one located rearwardly of each propeller, although a single rudder may be employed if preferred.

Since the propeller or propellers are essentially surface-running, it is necessary to provide a splash guard to prevent roostertailing. This may conveniently be done by providing a generally cylindrically shaped guard formed as a rearward extension of the duct, or a separate member carried by a bracket attached to the rear of the transom, which may also support the rudder.

Conveniently, the duct may be formed of the same resin bonded fiberglass or the like, of which the hull is formed and it may accordingly be built directly into the hull as it is formed. In this case, it is convenient to provide a rearward generally cylindrically formed extension on the duct to extend beyond the boat transom, which extension will form the splash guard.

Alternatively, where the invention is applied to a previously fabricated hull, the water flow duct or ducts will be formed by cutting away material of the hull and suitably forming the duct to become integral with the hull. In this case, the splash guard will usually be separately formed and attached to the rear of the transom to overlie or substantially overlie the propeller. The rudder post or posts is received in bearings which may be secured to the splash guard or to bracket means mounted on the rear of the transom.

BRIEF DESCRIPTION OF THE DRAWINGS

FIG. 1 is an elevational view, partly in section, showing a different embodiment of the invention.

FIG. 2 is an enlargement of the sectioned portion of FIG. 1.

FIG. 3 is a rear view of the boat hull illustrated in FIG. 1.

FIG. 4 is a rear elevation of a boat construction having twin propellers.

FIG. 5 is a fragmentary side elevation of the rear of the boat construction illustrated in FIG. 4.

FIG. 6 is a fragmentary section on the line 6—6 of FIG. 5.

Referring to FIG. 1, the boat is illustrated as in planing condition such that its keel 118 extends upwardly at a small angle. In practice it has been found that with a single engine construction the inclination of the of the boat at different speeds is in accordance with the following table:

| RPM | Degree of Inclination | Miles - MPH |
|---|---|---|
| 0 | 5° | — |
| 1000 | 6° | — |
| 1500 | 7° | — |
| 2000 | 9° | 18 |
| 2500 | 11° | 25 |
| 3000 | 13° | 30 |
| 3500 | 13° | 35 |
| 4000 | 13° | 40 |

It has been noted that for a twin engine boat, due to the substantially increased weight of the twin engines, the boat at rest may assume an angle of approximately 13°, which angle will not appreciably change as the boat is accelerated up to and through its planing range.

It will further be observed in FIG. 1 that in planing position, the rudder 38 extends substantially vertically so that no forced tending to roll the boat in either direction are developed.

Boat hulls of the type disclosed herein are commonly produced by laying up resin impregnated batts or fabrics formed of fibrous material such as fiberglass, and impregnated with resin adapted to cure to a hard condition. The fiber reinforced resin is usually laid up on a form and it is possible at this time to provide any desirable modified shapes. A particularly advantageous construction produced integrally by the molding of fiber reinforced resin is to provide the anti-roostertailing and anti-cavitation guard or cover as an integral extension of fiber reinforced resin extending rearwardly from the transom of the boat. Similarly, the fixed stabilizing and anti-cavitation plates 24 may be formed integrally with the boat hull, and more particularly, as an integral downward extension of the anti-cavitation and anti-roostertailing or splash guard plate 34.

A practical embodiment of this invention has been provided in which the structure for attachment to the hull weighs only about 48 pounds as compared to 200–500 pounds for presently known systems of generally similar performance.

In FIGS. 1 and 2 there is illustrated an improved construction in which the boat hull 110 has generally vertically extending sides 112 and generally flat upwardly and downwardly inclined bottom portions 116 which form the deep vee, preferably making angles of 17° to 27° with respect to the horizontal and intersecting at the keel 118. The hull is preferably formed from resin impregnated fiberglass and as initially laid up on the form it is shaped so as to provide the downwardly concave water supply duct 120 as heretofore described which extends rearwardly from the transom 122 to form the splash guard 124. Conveniently, the cross-sectional shape of the water supply duct is arcuate, as best seen in FIG. 12, and the splash guard 124 is formed as a continuation thereof projecting rearwardly from the transom 122. The propeller shaft 126 extends through an opening provided in the duct 120, a suitable seal being provided thereat as indicated at 128. The propeller shaft 126 is supported by a strut 130 having a shaft bearing 132 at its lower end and extending through an opening in the duct 120 to which it is connected by a plate 134 as illustrated.

Due to its generally arcuately formed cross-section, the rearwardly extending splash guard 124 is rigid and has sufficient strength to form an adequate support for a rudder bearing 136 which is bolted or otherwise secured to the upper surface of the splash guard. The rudder 138 has a post 140 adequately supported within the bearing and at its upper end is provided with an actuating arm 142 having a connector 144 for connection to a control device, such as a bowden wire or the like. Preferably, the rudder post bearing 136 and the arm 142 are within a housing 146 which may be formed of sheet material and attached to the rear surface of the transom 122 as indicated at 148.

The propeller 150 is here illustrated as of the type previously described which has the blades thereof extending rearwardly at a small angle with respect to a plane perpendicular to the propeller shaft so that the downwardly extending blade at the bottom of its arc extends substantially vertically and is thus capable of producing a substantially horizontal forward thrust.

As previously described, the rudder 138 in planing position occupies a vertical plane so that no forces are developed tending to roll the boat when the rudder is displaced from its zero or neutral position.

As best seen in FIG. 3, the rudder 138 is located directly behind the water supply duct so that it is in the path of water directed rearwardly from the boat by the propeller 150. Accordingly, exceptionally efficient steering results even at low boat speeds, due to the relative motion between the rudder and the water.

From an inspection of FIG. 2 it will be observed that the center of rotation of the propeller is approximately in the plane of the transom and is located directly rearwardly from a point 152 on the boat hull which is the intersection between the keel-line 118 and the forward end of the water supply duct 120. At planing speeds, the water displaced by the hull leaves a water level to the right of the point 152 such that the water level is approximately at the center point of the propeller. Accordingly, the propeller runs in a half-submerged condition so that the upper 180° of movement of the blades is not in the water.

It will be observed that the rudder 138 has a portion extending forwardly of the center line of the rudder post 140 and this provides a surface, when the rudder is inclined, which tends to balance the forces tending to rotate the propeller about its substantially vertical axis. This is particularly important since the water will be projected rearwardly at substantial velocity by the propeller directly against the rudder.

In FIG. 2, which is intended to illustrate an operating condition with the keel inclined upwardly at a substantial planing angle, the forward edge of the rudder, as indicated in full lines, is vertical. In some cases it is preferred to so shape the rudder that at least the submerged portion of its forward edge is forwardly and upwardly inclined as indicated by the dotted line 138*a*.

Referring now to FIGS. 4–6 there is illustrated an application of the present invention to a twin engine or twin propeller boat. In this case the propellers are illustrated at 160, carried by propeller shafts 162 which are supported within the water supply duct 164 by struts 166. The duct is constructed and arranged as heretofore described. In this case the ducts 164 and propellers 160 are located symmetrically at opposite sides of the keel 168 and preferably, the water supply ducts are formed integrally with the hull during its original laying up and extend rearwardly therefrom to provide the generally arcuately curved splash guards 170. Located directly in rear of each propeller 160 is a rudder 172, the rudders having posts 174 extending upwardly through the splash guards 170 and being there supported in bearings 176 fixedly secured to the upper surface of the rearwardly extending splash guards. The rudder posts 174 are provided with arms 178 extending in a fore and aft direction and interconnected by a rigid tie bar 180 which insures simultaneous equal turning movement of the twin rudders. Suitable actuating means is connected to one of the arms 178 or connected to tie bar 180, and is herein illustrated as a bowden wire 182 or the like, connecting to suitable mechanical steering mechanism. The construction is covered by a housing 184 suitably secured to the rear of the transom 186 by fastening means indicated at 188.

This twin propeller boat is exceptionally efficient both as to speed and steerability, the latter being the result of the alignment between the rudders 172 and the propellers 160.

It will be appreciated that the propeller shafts 162 extend forwardly and enter the interior of the boat through the hull wall which forms the forward end of the water supply ducts 164. A suitable gland or seal (not shown) is provided where the shaft 162 passes through the opening in the boat hull.

Ducts 120 of FIGS. 1–3 and 164 of FIGS. 4 and 5 extend forwardly of the transom a relatively short distance, as between 6 and 18 inches. The intersections between the forward end of the duct and the generally flat bottom surfaces of the boat are sharp corners so that at planing speed, the water flowing rearwardly along the bottom breaks away at the intersection. Due to the relatively short length of the duct, the water surface directly aft of this intersection occupies a substantially horizontal projection of the intersection which passes substantially centrally through the associated propeller or propellers, as best seen in FIG. 2.

It will be apparent from the foregoing that at planing speed the propeller or propellers runs in a half-submerged condition. It will be obvious of course that the geometry giving rise to this condition involves the inclination of the hull at planing speed, and the location of the breakaway surface at the front of the duct, which of course depends on the length of the duct, and the location of the propeller or propellers.

What I claim as my invention is:

1. A boat having a transversely convex deep-vee planing type hull in which the bottom of the hull comprises generally flat surfaces which intersect to define the keel of the hull and which extend upward and outwardly from the keel at equal angles between 15° and 30° from the transverse plane through the keel, said hull having a transom at the stern extending upwardly and preferably slightly rearwardly from the keel, said boat having inboard engine means located aft of the longitudinal center of the boat, the weight and location of the engine means with respect to the hull characteristics being such that at rest in the water, the keel of said hull is inclined forwardly and upwardly at a small angle from the horizontal and at planing speeds the forward and upward inclination of the keel is at a substantially greater angle, said hull having a water flow duct in its bottom located to extend forwardly and downwardly from the intersection between the bottom of the hull and the transom, said duct being open downwardly through the bottom of the hull and open rearwardly through the transom, a propeller located in alignment with the duct and adjacent the plane occupied by the transom, said duct comprising a downwardly and rearwardly open transversely curved channel intersecting the transom to define therewith an opening having an approximate radius slightly greater than the radius of the propeller, and including a top wall which is forwardly and downwardly curved to intersect the bottom of the hull in sharp cornered intersections a short distance forward of the transom, the sharp cornered intersections between the top front wall of said duct and the bottom of said hull being effective at planing speed to cause water flowing rearwardly along the bottom of the hull to break away from the bottom surface of the hull and to prevent this water from flowing along the duct surface into said duct, said propeller having a propeller shaft connected to the engine means extending into the interior of the hull and inclined slightly forwardly and upwardly to position the center of rotation of the propeller generally directly astern of and closely adjacent to the horizontal plane which extends rearwardly from the sharp cornered intersections when said boat is at planing inclination to provide for running of said propeller in half-submerged condition, a splash guard extending rearwardly of said transom from said duct in general alignment therewith and positioned to intercept the spray produced by said surface running propeller and a rudder directly astern of said propeller to receive water projected rearwardly thereby.

2. A boat as defined in claim 1 in which the top wall of said duct includes an integral rearward extension which constitutes said splash guard.

3. A boat as defined in claim 2 in which said boat hull and said duct and its rearward extension are integrally formed of resin-bonded fibrous material.

4. A boat as defined in claim 1 in which said duct terminates at said transom, and in which said splash guard is attached to the rear surface of said transom.

5. A boat as defined in claim 1 in which said propeller has blades inclined obliquely to the propeller shaft so that in planing, the submerged blades extend substantially perpendicularly to the direction of movement of the boat.

6. A boat as defined in claim 1, said boat hull, duct, and splash guard being integrally formed in resin impregnated fibrous material, the downwardly concave shape of said guard providing sufficient rigidity to provide for support of said rudder thereon.

7. A boat as defined in claim 1, in which the front end of the duct is 6–18 inches forward of the transom.

8. A boat as defined in claim 7, in which said boat has a single propeller and in which said propeller and its water supply duct are on the center line of said hull.

9. A boat as defined in claim 8, in which at rest in the water, said hull assumes a forward and upward inclination of about 5°.

10. A boat as defined in claim 2, in which said boat has two propellers and in which each propeller has a water supply duct extending forwardly therefrom, and in which said propellers and their water supply ducts are equally spaced outwardly from the longitudinal center line of said hull.

11. A boat as defined in claim 10 in which each duct and associated propeller has a splash guard and a rudder directly astern thereof, each of which has a rotatable post extending through an opening in the associated splash guard, a housing mounted to extend across both splash guards into which said posts extend, arms on said posts in said housing, a link rigidly connecting said arms for simultaneous rotation to operate said rudders, and remotely operable actuating means connected to said link.

12. A boat as defined in claim 7, in which said duct is of generally semi-circular cross section having a radius of curvature only slightly greater than the radius of said propeller.

* * * * *